US011305855B1

(12) United States Patent
Payne

(10) Patent No.: US 11,305,855 B1
(45) Date of Patent: Apr. 19, 2022

(54) TROLLING MOTOR RELEASABLE BRACKET SYSTEM AND ASSOCIATED METHODS

(71) Applicant: Power Pux, LLC, Wilmington, DE (US)

(72) Inventor: Paul E Payne, Cocoa, FL (US)

(73) Assignee: POWER PUX, LLC, Cocoa, FL (US)

( * ) Notice: Subject to any disclaimer, the term of this patent is extended or adjusted under 35 U.S.C. 154(b) by 1 day.

(21) Appl. No.: 17/075,330

(22) Filed: Oct. 20, 2020

(51) Int. Cl.
*B63H 20/06* (2006.01)
*B63H 20/00* (2006.01)
*B63B 3/48* (2006.01)

(52) U.S. Cl.
CPC ..... *B63H 20/007* (2013.01); *B63B 3/48* (2013.01); *B63H 20/06* (2013.01)

(58) Field of Classification Search
CPC ..... B63H 20/007; B63H 20/06; B63H 20/00; B63B 3/48
See application file for complete search history.

(56) References Cited

U.S. PATENT DOCUMENTS 3,750,988 A * 8/1973 Lyon ..... B63H 20/10 248/641
4,682,960 A 7/1987 Hendrickson
4,708,670 A * 11/1987 Peters ..... B63H 20/007 248/642
4,729,745 A 3/1988 Edwards
4,819,905 A 4/1989 McCain
6,254,441 B1 7/2001 Knight et al.
6,325,685 B1 12/2001 Knight et al.
6,431,923 B1 8/2002 Knight et al.
7,004,804 B2 2/2006 Bernloehr et al.
7,195,526 B2 3/2007 Bernloehr et al.
7,285,029 B1 10/2007 Janitz
7,294,029 B1 11/2007 Spaulding
7,399,211 B1 7/2008 Spaulding
8,425,268 B2 4/2013 Daikoku et al.
8,814,129 B2 8/2014 Todd et al.
9,248,897 B2 2/2016 Shields
9,290,251 B1 3/2016 Schmidtke
9,296,455 B2 3/2016 Bernloehr et al.
9,630,695 B2 4/2017 Reed
9,676,462 B2 6/2017 Bernloehr et al.
(Continued)

*Primary Examiner* — Stephen P Avila
(74) *Attorney, Agent, or Firm* — Mark Malek; Paul Ditmyer; Widerman Malek, PL

(57) ABSTRACT

The trolling motor releasable mounting bracket system is for trolling motors (e.g., GPS guided trolling motors), includes its own power plug within the assembly, and is configured to mount a trolling motor to a vessel deck. The system includes a motor bracket and a vessel bracket. The motor bracket includes a receiving section to slidably receive the vessel bracket therein. The motor bracket further includes a motor power cord section including a motor power cord channel configured to route a motor power cord and secure an associated motor power connector therein. The vessel bracket includes a vessel power cord section including a vessel power cord channel configured to route a vessel power cord and secure an associated vessel power connector therein, And, the motor power cord channel and the vessel power cord channel are configured to align the respective motor power connector and the vessel power connector.

16 Claims, 4 Drawing Sheets

(56) References Cited

U.S. PATENT DOCUMENTS

| | | | |
|---|---|---|---|
| 10,029,775 | B2 | 7/2018 | Nikmanesh |
| 10,155,579 | B2 | 12/2018 | Marchio |
| 10,633,069 | B2 | 4/2020 | Reed |
| 10,689,081 | B2 | 6/2020 | Shields |
| 2002/0111083 | A1 | 8/2002 | Gilley |
| 2005/0255761 | A1 | 11/2005 | Bernloehr et al. |
| 2015/0298782 | A1 | 10/2015 | Bernloehr et al. |
| 2019/0322340 | A1 | 10/2019 | Clark |

* cited by examiner

TROLLING MOTOR RELEASABLE BRACKET SYSTEM AND ASSOCIATED METHODS

FIELD OF THE INVENTION

The present invention relates to the field of boating, and more particularly to systems, devices and methods for releasably mounting a trolling motor to a vessel deck.

BACKGROUND OF THE INVENTION

A trolling motor is a self-contained unit that includes an electric motor, propeller and controls, and is affixed to an angler's boat, either at the bow or stern. Trolling motors are often lifted from the water to reduce drag when the boat's primary engine is in operation. The trolling motor provides auxiliary power for precision maneuvering of the boat, to enable the angler to cast bait to where the fish are located. Trolling motors designed for this application are typically mounted in the bow.

An 1895 article in Scientific American entitled "A Portable Electric Propeller for Boats" stated: "Briefly described, it consists of a movable tube which is hinged at the stern of the boat, much as an oar is used in sculling. The tube contains a flexible shaft formed of three coils of phosphor bronze. This tube extends down and out into the water, where it carries a propeller, and at the inboard end an electric Motor is attached, which is itself driven by batteries."

The electric trolling motor was invented by O. G. Schmidt in 1934 in Fargo, N. Dak., when he took a starter motor from a Ford Model A, added a flexible shaft, and a propeller. Because his manufacturing company was near the Minnesota/North Dakota border, he decided to call the new company Minn Kota. The company still is a major manufacturer of trolling motors.

Modern electric trolling motors are designed around a 12-volt, 24-volt or 36-volt brushed DC electric motor, to take advantage of the availability of 12-volt deep cycle batteries designed specifically for marine use. The motor itself is sealed inside a watertight compartment at the end of the shaft. It is submerged during operation, which prevents overheating. The propeller is fitted directly on to the prop shaft.

Hand controlled trolling motors are attached to the boat with a clamp. On/off and speed controls may also be foot-operated and built into a pedal that also controls the steering mechanism, Steering may be via electronically controlled servo motors, or in early-model (and late-model low-end units), a push-pull cable. Foot controlled trolling motors require a specialized mounting bracket that bolts horizontally to the deck. An advantage of foot controls is that fisherman has both hands free for fishing and landing the hooked fish. On the other hand, it is sometimes hard to coordinate foot work with hands, especially in wavy and windy conditions. Wireless remote control may be available on high-end late-model trolling motors. Servo-controlled steering and speed control both respond to a wireless device (e.g. including geolocation data, such as Global Positioning Satellite GPS), either in a foot pedal or a key-fob transmitter.

U.S. Pat. No. 10,155,579 to Marcia is directed to an electric propulsion system for small boats and kayaks. Each trolling motor is connected to a motor mount stub that clicks into a main system mount that straddles the gunnels of a boat. In Marcio, FIG. 3 is a Wiring Integration within the Main System Mount, and FIG. 4 Shows how the main power wires of the motor are connected to the lugs on each motor stub. FIG. 5 shows how the boat operator "mechanically" connects a trolling motor to each motor mount stub. It is described therein that the motor wiring simply attaches to lug studs on the motor mount stubs and that the two power cords of each motor are bundled so as not to flop around and connect to lug bolts (see FIG. 4) under the Motor Mount Stub. There are no self-contained electrical connectors in the system.

Also, U.S. Pat. No. 6,431,923 to Knight et al. (Johnson Outdoors Inc.) is directed to a Trolling Motor Bow Mount that includes a base, a chassis, and an actuation mechanism. FIG. 2 is a side elevational view illustrating the trolling motor system of FIG. 1 being dismounted from the boat via a bow mount system. FIG. 3 is a sectional view of the bow mount system of FIG. 2 taken along lines 3-3. FIG. 4 is a sectional view of the bow mount system of FIG. 3 illustrating a chassis lowered onto a base of the bow mount system. Although the mount of Knight et al, includes interleaving dovetails on the base and chassis for mounting the motor to a vessel, there is no description of self-contained electrical connectors within the base and chassis.

Additionally, U.S. Pat. No. 10,689,081 to Shields is directed to a mount and control system for an electric outboard. As described in this reference, in some embodiments, the wire harness connects to the motor and terminates at a quick electrical disconnect which couples to an electrical extension at a location . . . that is in the dry storage and approximately underneath the hatch. It is further described that the location allows for easy access to the disconnect and provides for simple and quick attachment and detachment of the wire harness when installing or removing parts of the mount and control system.

However, even though the reference discusses a "quick electrical disconnect", such disconnect is not integrated with the mounting or fastening components.

What is needed is a trolling motor quick release bracket system that includes its own power plug within the assembly to more easily mount and dismount the trolling motor onto/from the vessel.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a trolling motor releasable mounting bracket system that includes its own power plug within the assembly to more easily mount and dismount the trolling motor onto/from the vessel and reduce associated wires on the boat deck.

The embodiments of the invention are directed to a trolling motor releasable mounting bracket system for trolling motors (e.g., GPS guided trolling motors) that includes its own power plug within the assembly. It may be designed as an Original Equipment Manufacturer (OEM) system for new boats and/or as an aftermarket system to retrofit with most pre-drilled mounting patterns for those who wish to convert from a previous quick release product.

This and other objects, advantages and features in accordance with the present embodiments may be provided by a trolling motor releasable mounting bracket system configured to mount a trolling motor to a vessel deck. The system includes a motor bracket configured to be mounted to a base of the trolling motor, and a vessel bracket configured to be mounted to the vessel deck. The motor bracket includes a receiving section, extending inwardly from a first end thereof, and configured to slidably receive the vessel bracket therein. The motor bracket further includes a motor power cord section, extending inwardly from a second end and to the receiving section, and including a motor power cord channel configured to route a motor power cord and secure an associated motor power connector therein. The vessel bracket includes a vessel power cord section, extending inwardly from a first end thereof, and including a vessel power cord channel configured to route a vessel power cord and secure an associated vessel power connector therein, And, the motor power cord channel and the vessel power cord channel are configured to align the respective motor power connector and the vessel power connector, for automatic connection, upon the vessel bracket being slidably received in the receiving section of the motor bracket.

Additionally, and/or alternatively, the motor bracket includes a first passageway adjacent the receiving section, and the vessel bracket includes a second passageway configured to align with the first passageway and receive a locking pin therethrough.

Additionally, and/or alternatively, the motor bracket further includes a locking pin tab that protrudes from a side thereof adjacent the first passageway, and a locking pin is configured to rest on the locking pin tab and extend through the first and second passageways to lock the motor bracket to the vessel bracket and lock the trolling motor to the vessel deck.

Additionally, and/or alternatively, the motor bracket includes at least one pattern of base fastener holes configured to receive fasteners to secure the motor bracket to the base of the trolling motor, and the vessel bracket includes at least one pattern of deck fastener holes configured to receive fasteners to secure the vessel bracket to the deck of the vessel.

Additionally, and/or alternatively, the motor power cord section of the motor bracket includes a motor power cord section cover that covers the motor power cord channel to secure the motor power connector within the motor power cord channel.

Additionally, and/or alternatively, the vessel power cord section of the vessel bracket includes a vessel power cord section cover that covers the vessel power cord channel to secure the vessel power connector within the vessel power cord channel.

Additionally, and/or alternatively, the vessel power cord section cover includes an outlet configured to route the vessel power cord externally of the vessel bracket and into the deck of the vessel.

Additionally, and/or alternatively, the motor bracket and vessel bracket include respective guide rails configured to provide the slidable installation of the motor bracket onto the vessel bracket.

Other objects, advantages and features in accordance with the present embodiments may be provided by a trolling motor releasable mounting bracket system configured to mount a trolling motor to a vessel deck. The system includes a motor bracket configured to be mounted to a base of the trolling motor, and a vessel bracket configured to be mounted to the vessel deck. A motor power cord has an associated motor power connector, and a vessel power cord has an associated vessel power connector. The motor bracket includes a receiving section, extending inwardly from a first end thereof, and configured to slidably receive the vessel bracket therein. The motor bracket and vessel bracket include respective guide rails configured to provide the slidable installation of the motor bracket onto the vessel bracket. The motor bracket further includes a motor power cord section, extending inwardly from a second end and to the receiving section, and including a motor power cord channel configured to route the motor power cord and secure an associated motor power connector therein. The vessel bracket includes a vessel power cord section, extending inwardly from a first end thereof, and including a vessel power cord channel configured to route the vessel power cord and secure an associated vessel power connector therein. The motor power cord channel and the vessel power cord channel are configured to align the respective motor power connector and the vessel power connector, for automatic connection, upon the vessel bracket being slidably received in the receiving section of the motor bracket. The motor bracket includes a first passageway adjacent the receiving section, and the vessel bracket includes a second passageway configured to align with the first passageway and receive a locking pin therethrough to lock the motor bracket to the vessel bracket and lock the trolling motor to the vessel deck.

Additionally, and/or alternatively, the motor bracket further comprises a locking pin tab that protrudes from a side thereof adjacent the first passageway to support a proximal end of the locking pin.

Additionally, and/or alternatively, the motor bracket includes at least one pattern of base fastener holes configured to receive fasteners to secure the motor bracket to the base of the trolling motor, and the vessel bracket includes at least one pattern of deck fastener holes configured to receive fasteners to secure the vessel bracket to the deck of the vessel.

Additionally, and/or alternatively, the motor power cord section of the motor bracket includes a motor power cord section cover that covers the motor power cord channel to secure the motor power connector within the motor power cord channel.

Additionally, and/or alternatively, the vessel power cord section of the vessel bracket includes a vessel power cord section cover that covers the vessel power cord channel to secure the vessel power connector within the vessel power cord channel.

Additionally, and/or alternatively, the vessel power cord section cover includes an outlet configured to route the vessel power cord externally of the vessel bracket and into the deck of the vessel.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 2:
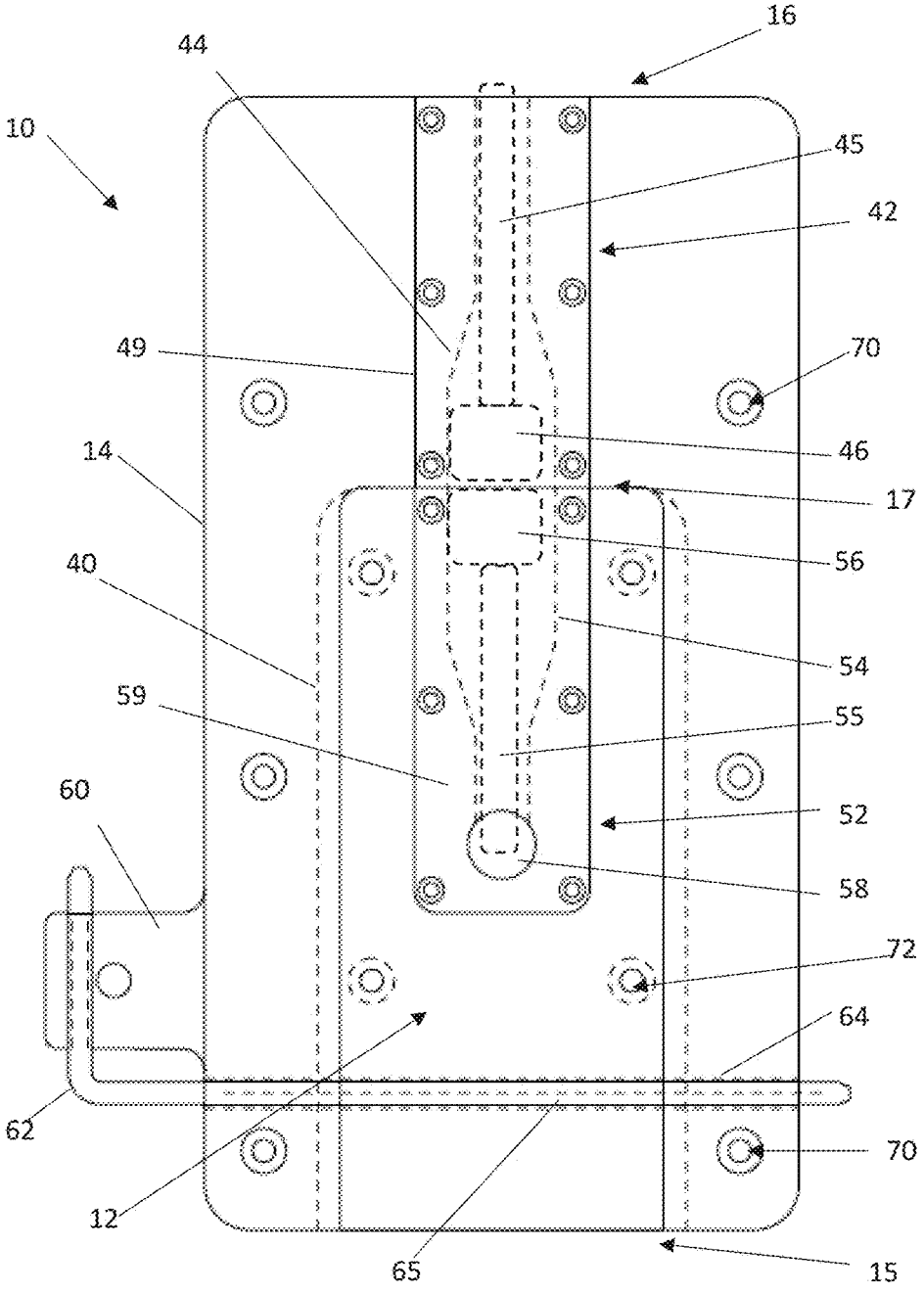
FIG. 2 is a side view of the trolling motor releasable mounting bracket system of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Before describing the present disclosure in detail, it is to be understood that this disclosure is not limited to parameters of the particularly exemplified systems, methods, apparatus, products, processes, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "embodiment," "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "sensor" includes one, two, or more sensors.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

An embodiment of the invention, as shown and described by the various figures and accompanying text, provides a system that includes brackets configured to slidably engage for mounting the motor to the vessel while also internally electrically coupling (e.g., with self-contained electrical connectors) the motor to a vessel power supply connector within the vessel bracket or puck. The motor bracket includes a feature to route and secure the power cord of the motor within the bracket and positioned for connection to the corresponding electrical connector at one end of the puck when the motor is slidably mounted to the puck and vessel. A storage puck may be provided for mounting the motor (e.g. in the garage) when not in use.

Some of the illustrative aspects of the present invention may be advantageous in solving the problems herein described and other problems not discussed which are discoverable by a skilled artisan.

Figure 1:
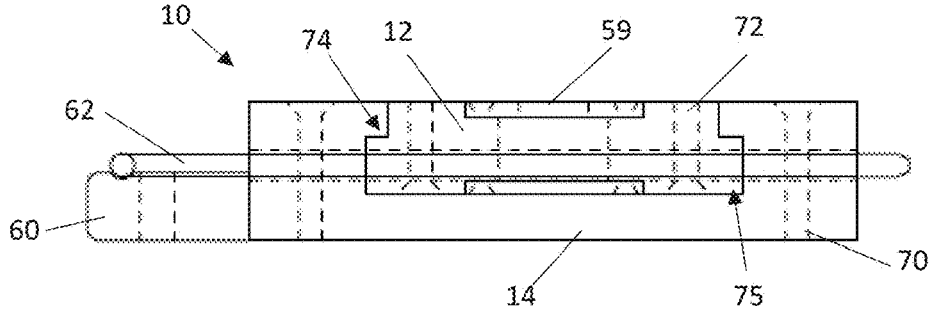
FIG. 1 is a bottom view of a trolling motor releasable mounting bracket system with the vessel bracket received within the motor bracket according to an embodiment of the present invention.
Figure 3:
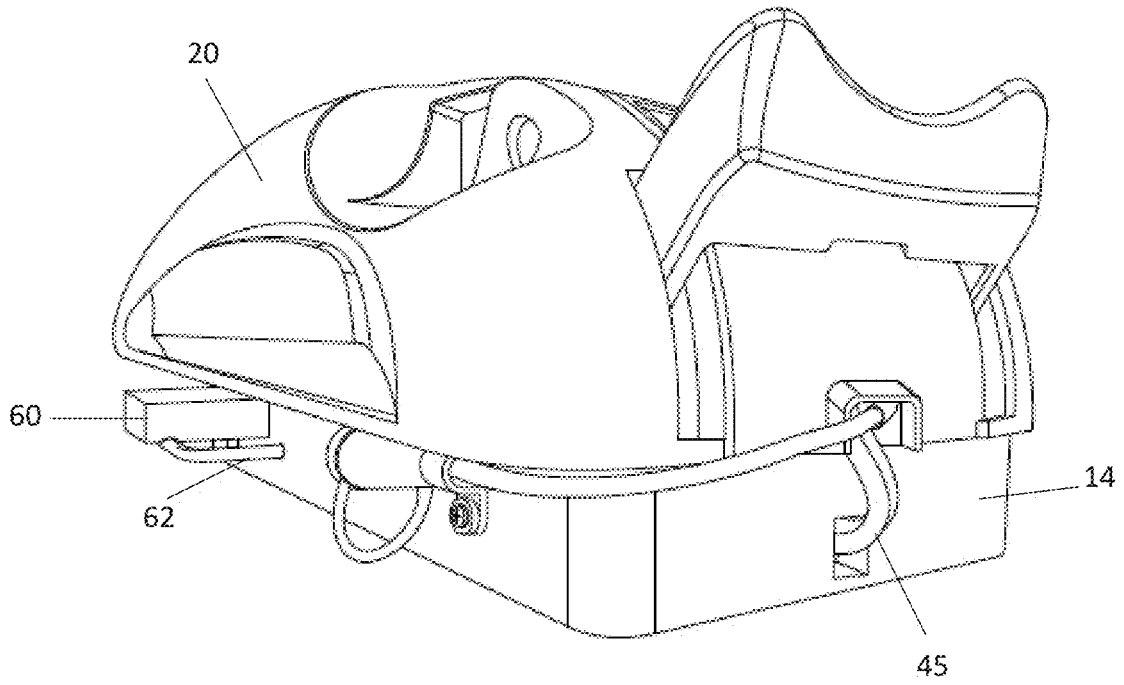
FIG. 3 is a perspective view of a trolling motor base secured to the motor bracket of the trolling motor releasable mounting bracket system of FIG. 1.
Figure 4:
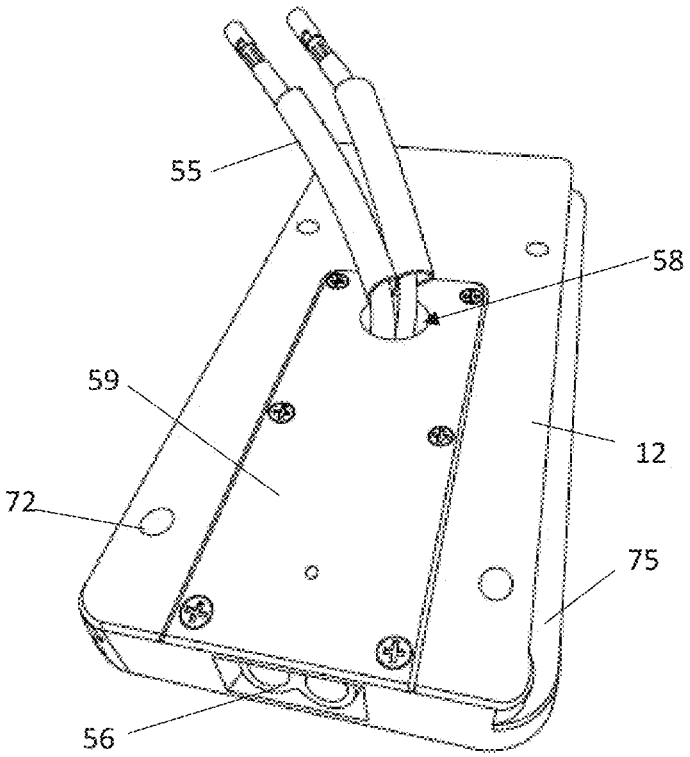
FIG. 4 is a perspective bottom view of the vessel bracket of the trolling motor releasable mounting bracket system of FIG. 1.
Figure 5:
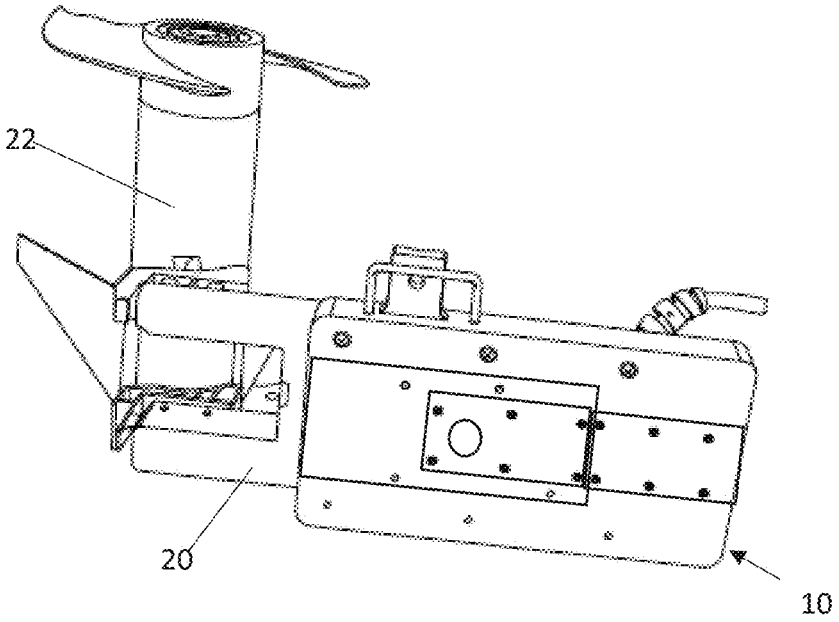
FIG. 5 is a perspective bottom view of the trolling motor releasable mounting bracket system secured to a trolling motor.
Figure 6:
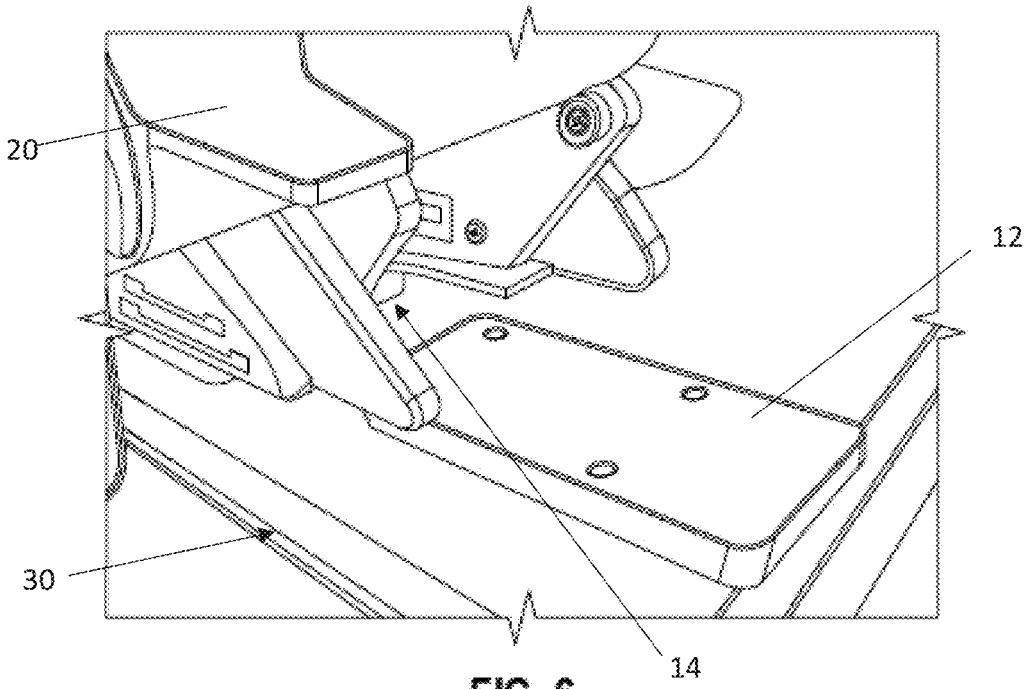
FIG. 6 is a perspective side view of the trolling motor base secured to the motor bracket and ready for installation onto the vessel bracket mounted to the deck of the vessel.
Figure 7:
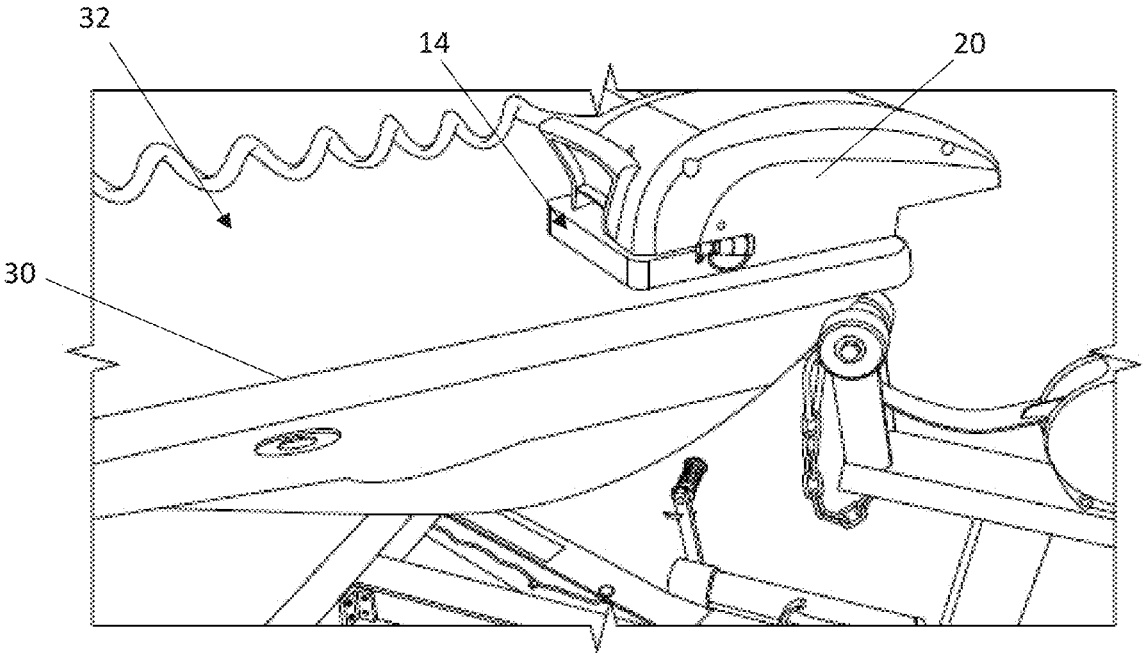
FIG. 7 is a perspective view of the trolling motor base secured to the motor bracket and installed onto the vessel bracket mounted to the deck of the vessel.
Figure 8:
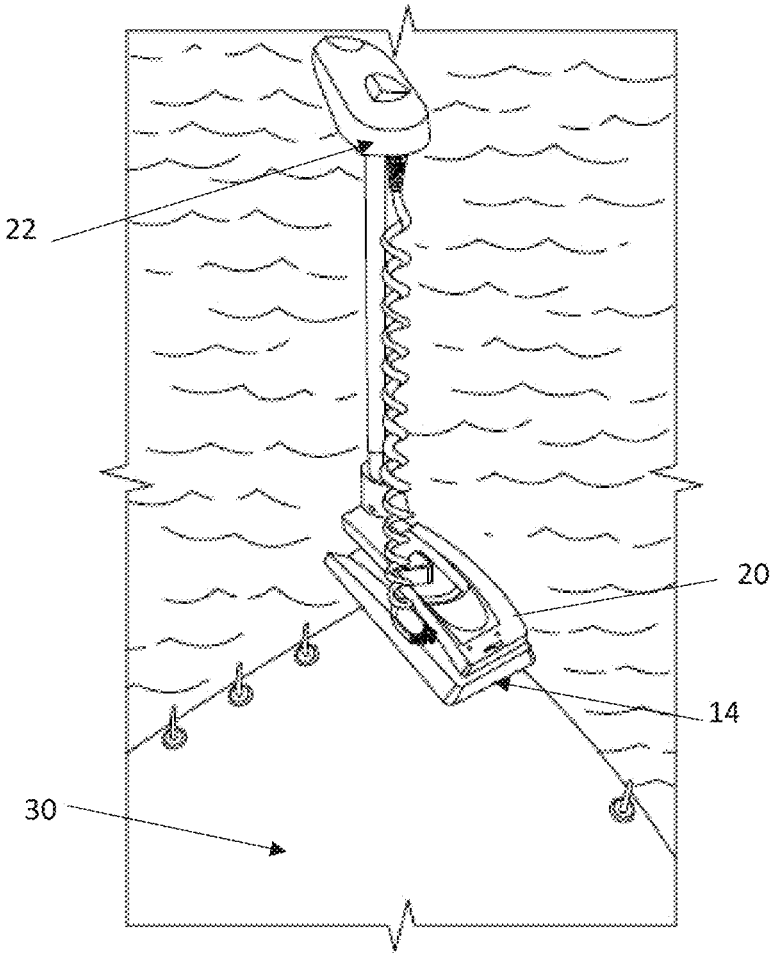
FIG. 8 is a perspective view of the trolling motor assembly secured to the motor bracket, installed onto the vessel bracket mounted to the deck of the vessel, and positioned for trolling operation.

An embodiment of the present invention is directed to a trolling motor releasable mounting bracket system and is described below with reference to FIGS. 1-8. FIG. 1 is a bottom view of a trolling motor releasable mounting bracket system 10 with a vessel bracket 12 received within a motor bracket 14, FIG. 2 is a side view of the trolling motor releasable mounting bracket system 10. FIG. 3 is a perspective view of a trolling motor base 20, of a typical trolling motor 22, and secured to the motor bracket 14 of the trolling motor releasable mounting bracket system 10. FIG. 4 is a perspective bottom view of the vessel bracket 12. FIG. 5 is a perspective bottom view of the trolling motor releasable mounting bracket system 10, including the motor bracket 14 being secured to the trolling motor 22, and the vessel bracket 12 being received by the motor bracket 14. FIG. 6 is a perspective side view of the trolling motor base 20 secured to the motor bracket 14 and ready for installation onto the vessel bracket 12 mounted to the deck 30 of a vessel 32. FIG. 7 is a perspective view of the trolling motor base 20 secured to the motor bracket 14 and installed onto the vessel bracket 12 mounted to the deck 30 of the vessel 32. FIG. 8 is a perspective view of the trolling motor assembly 24 secured to the motor bracket 14, via the motor base 20, and installed onto the vessel bracket 12 mounted to the deck 30 of the vessel 32 and positioned upright for trolling operation.

Thus, the trolling motor releasable mounting bracket system 10 is configured to mount the trolling motor 22 to the vessel deck 30. Herein, the vessel deck 30 refers to any surface (e.g. top deck, deck cap, floor, etc.) that can mount the vessel bracket 12 above the hull. The system 10 includes the motor bracket 14 configured to be mounted to the base 20 of the trolling motor 22, and the vessel bracket 12 configured to be mounted to the vessel deck 30. The motor bracket 14 includes a receiving section 40, extending inwardly from a first end 15 thereof, and configured to slidably receive the vessel bracket 12 therein. The motor bracket 14 and vessel bracket 12 include respective guide rails 74, 75 configured to provide the slidable installation of the motor bracket 14 onto the vessel bracket 12.

The motor bracket 14 further includes a motor power cord section 42, extending inwardly from a second end 16 and to the receiving section 40, and including a motor power cord channel 44 configured to route a motor power cord 45 and secure an associated motor power connector 46 therein. The vessel bracket 12 includes a vessel power cord section 52, extending inwardly from a first end thereof 17, and including a vessel power cord channel 54 configured to route a vessel power cord 55 and secure an associated vessel power connector 56 therein. And, the motor power cord channel 44 and the vessel power cord channel 54 are configured to align the respective motor power connector 56 and the vessel power connector 46, for automatic connection, upon the vessel bracket 12 being slidably received in the receiving section 40 of the motor bracket 14.

The motor bracket 14 includes a first passageway 64 adjacent the receiving section 40, and the vessel bracket 12 includes a second passageway 65 configured to align with the first passageway 64 and receive a locking pin 62 therethrough. The motor bracket 14 may further include a locking pin tab 60 that protrudes from a side thereof adjacent the first passageway 64. The locking pin 62 is configured to rest on the locking pin tab 60 and extend through the first and second passageways 64, 65 to lock the motor bracket 14 to the vessel bracket 12. This feature also locks the trolling motor 22 to the vessel deck 30. A lock may be used to secure the locking pin 62 to the locking pin tab 60 and provide security for the trolling motor 22 on the vessel 32 while being stored or transported. In the embodiment illustrated in FIGS. 1 and 2, the locking pin 62 extends through the brackets 12, 14; however, in other embodiments, the locking pin 62 may include a U-shaped design that does not extend out of the opposite side of the motor bracket 14. Other arrangements are also contemplated as long as the brackets 12, 14 are locked together by the locking pin 62.

The motor bracket 14 may include one or more patterns of base fastener holes 70 configured to receive fasteners to secure the motor bracket 14 to the base 20 of the trolling motor 22. Likewise, the vessel bracket may include at least one pattern of deck fastener holes 72 configured to receive fasteners to secure the vessel bracket 14 to the deck 30 of the vessel 32.

The motor power cord section 42 of the motor bracket 14 includes a motor power cord section cover 49 that covers the motor power cord channel 44 to secure the motor power connector 46 within the motor power cord channel 44. The motor power cord section cover 49 can be fastened to the motor bracket 14, with stainless steel screws, for example. The vessel power cord section 52 of the vessel bracket 12 includes a vessel power cord section cover 59 that covers the vessel power cord channel 54 to secure the vessel power connector 56 within the vessel power cord channel 54. The vessel power cord section cover 59 can be fastened to the vessel bracket 12, with stainless steel screws, for example. The vessel power cord section cover 59 includes an outlet 58 configured to route the vessel power cord 55 externally of the vessel bracket 12 and into the deck 30 of the vessel 32.

The trolling motor releasable mounting bracket system 10, aka "Power Pux", is a quick release bracket with its own self-contained power connectors or plugs 46, 56 designed to provide electrical power to a 12-volt, 24-volt, or 36-volt trolling motor 22 at the moment the trolling motor is installed on the vessel 32. The self-contained power connectors 46, 56 preferably are 60-amp rated electrical connectors which together serve to transfer the vessel battery power to the trolling motor 22 once the motor bracket 14 and vessel bracket 12 are connected together.

The existing 8-gauge wires supplied from the trolling motor 22 are to be connected to the motor power cord 45 (e.g. two supplied 8-gauge wires) exiting from the motor bracket 14. The vessel power cord 55 (e.g. two supplied 8-gauge wires) will pass through the top deck of the deck 30 of the vessel 32 and then connect with the vessel's battery wires. A 60-amp surge protector breaker may be recommended between the vessel power cord 55 and the vessel battery or power supply. The vessel bracket should preferably be sealed with marine caulking/sealant around the outlet 58 and mounting holes 72 on the top deck surface of the deck 30 to prevent water leakage below the deck.

Once the brackets 12, 14 are properly affixed and secured to the top deck and to the trolling motor 22 and the battery power leads have been connected, the trolling motor assembly with the motor bracket 14 can be slid forward on the vessels top deck and slid onto the vessel bracket 12 aligning the guide rails 74, 75 and pushed forward until the power connectors 46 and 56 latch together. The locking pin 62 is slid into the passageways 64, 65 and may be secured with an optional lock (e.g. a padlock) for theft protection.

When the 60-amp surge protection breaker is turned on, the trolling motor releasable mounting bracket system 10 will supply the trolling motor 22 with power for safe operation (e.g. including GPS guidance) without the need for external power cords and plugs to trip on or entangle a user's fishing line.

The brackets 12, 14 may be made of a thermoplastic polymer, for example, 1½" inch quality marine-grade High Density Poly Ethylene (HDPE) that is cut and milled to desired specifications. Size in length, width and height, as well as materials, can be selected for different makes and models of vessels, trolling motors or other requested applications as needed. Colors can vary according to availability from the thermoplastic suppliers.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items. Thus, the scope of the invention should be determined by the appended claims and their legal equivalents, and not by the examples given.

The invention claimed is:

1. A trolling motor releasable mounting bracket system configured to mount a trolling motor to a vessel deck, the system comprising:

a motor bracket configured to be mounted to a base of the trolling motor; and a vessel bracket configured to be mounted to the vessel deck;

wherein the motor bracket includes a receiving section, extending inwardly from a first end thereof, and configured to slidably receive the vessel bracket therein;

wherein the motor bracket further includes a motor power cord section, extending inwardly from a second end and to the receiving section, and including a motor power cord channel configured to route a motor power cord and secure an associated motor power connector therein;

wherein the vessel bracket includes a vessel power cord section, extending inwardly from a first end thereof, and including a vessel power cord channel configured to route a vessel power cord and secure an associated vessel power connector therein; and wherein the motor power cord channel and the vessel power cord channel are configured to align the respective motor power connector and the vessel power connector, for automatic connection, upon the vessel bracket being slidably received in the receiving section of the motor bracket.

2. The trolling motor releasable mounting bracket system according to claim 1, wherein the motor bracket includes a first passageway adjacent the receiving section, and the vessel bracket includes a second passageway configured to align with the first passageway and receive a locking pin therethrough.

3. The trolling motor releasable mounting bracket system according to claim 2, wherein the motor bracket further comprises a locking pin tab that protrudes from a side thereof adjacent the first passageway; and further comprising a locking pin configured to rest on the locking pin tab and extend through the first and second passageways to lock the motor bracket to the vessel bracket and lock the trolling motor to the vessel deck.

4. The trolling motor releasable mounting bracket system according to claim 1, wherein the motor bracket includes at least one pattern of base fastener holes configured to receive fasteners to secure the motor bracket to the base of the trolling motor.

5. The trolling motor releasable mounting bracket system according to claim 1, wherein the vessel bracket includes at least one pattern of deck fastener holes configured to receive fasteners to secure the vessel bracket to the vessel deck.

6. The trolling motor releasable mounting bracket system according to claim 1, wherein the motor power cord section of the motor bracket includes a motor power cord section cover that covers the motor power cord channel to secure the motor power connector within the motor power cord channel.

7. The trolling motor releasable mounting bracket system according to claim 1, wherein the vessel power cord section of the vessel bracket includes a vessel power cord section cover that covers the vessel power cord channel to secure the vessel power connector within the vessel power cord channel.

8. The trolling motor releasable mounting bracket system according to claim 7, wherein the vessel power cord section cover includes an outlet configured to route the vessel power cord externally of the vessel bracket and into the vessel deck.

9. The trolling motor releasable mounting bracket system according to claim 1, wherein the motor bracket and vessel bracket include respective guide rails configured to provide the slidable installation of the motor bracket onto the vessel bracket.

10. A trolling motor releasable mounting bracket system configured to mount a trolling motor to a vessel deck, the system comprising:

a motor bracket configured to be mounted to a base of the trolling motor;

a vessel bracket configured to be mounted to the vessel deck;

a motor power cord and an associated motor power connector;

a vessel power cord and an associated vessel power connector; and a locking pin;

wherein the motor bracket includes a receiving section, extending inwardly from a first end thereof, and configured to slidably receive the vessel bracket therein;

wherein the motor bracket and vessel bracket include respective guide rails configured to provide the slidable installation of the motor bracket onto the vessel bracket;

wherein the motor bracket further includes a motor power cord section, extending inwardly from a second end and to the receiving section, and including a motor power cord channel configured to route the motor power cord and secure an associated motor power connector therein;

wherein the vessel bracket includes a vessel power cord section, extending inwardly from a first end thereof, and including a vessel power cord channel configured to route the vessel power cord and secure an associated vessel power connector therein;

wherein the motor power cord channel and the vessel power cord channel are configured to align the respective motor power connector and the vessel power connector, for automatic connection, upon the vessel bracket being slidably received in the receiving section of the motor bracket; and wherein the motor bracket includes a first passageway adjacent the receiving section, and the vessel bracket includes a second passageway configured to align with the first passageway and receive the locking pin therethrough to lock the motor bracket to the vessel bracket and lock the trolling motor to the vessel deck.

11. The trolling motor releasable mounting bracket system according to claim 10, wherein the motor bracket further comprises a locking pin tab that protrudes from a side thereof adjacent the first passageway to support a proximal end of the locking pin.

12. The trolling motor releasable mounting bracket system according to claim 10, wherein the motor bracket includes at least one pattern of base fastener holes configured to receive fasteners to secure the motor bracket to the base of the trolling motor.

13. The trolling motor releasable mounting bracket system according to claim 10, wherein the vessel bracket includes at least one pattern of deck fastener holes configured to receive fasteners to secure the vessel bracket to the vessel deck.

14. The trolling motor releasable mounting bracket system according to claim 10, wherein the motor power cord section of the motor bracket includes a motor power cord section cover that covers the motor power cord channel to secure the motor power connector within the motor power cord channel.

15. The trolling motor releasable mounting bracket system according to claim 10, wherein the vessel power cord section of the vessel bracket includes a vessel power cord section cover that covers the vessel power cord channel to secure the vessel power connector within the vessel power cord channel.

16. The trolling motor releasable mounting bracket system according to claim 15, wherein the vessel power cord section cover includes an outlet configured to route the vessel power cord externally of the vessel bracket and into the vessel deck.

* * * * *